US009340943B2

(12) United States Patent
Da Silva Arêde et al.

(10) Patent No.: US 9,340,943 B2
(45) Date of Patent: May 17, 2016

(54) METHOD AND TOOL FOR FORMING A SEAL IN A BLOCK CHAMBER OF A SHEET PILE

(75) Inventors: Luis Da Silva Arêde, Luxembourg (LU); Anne Fagot, Audun-Le-Tiche (FR); Thierry Mauer, Redange (FR); Pol Reichert, Luxembourg (LU)

(73) Assignee: Arcelormittal Investigación Y Desarrollo S.L., Bizkaia (ES)

( * ) Notice: Subject to any disclaimer, the term of this patent is extended or adjusted under 35 U.S.C. 154(b) by 0 days.

(21) Appl. No.: 14/408,811

(22) PCT Filed: Jul. 3, 2012

(86) PCT No.: PCT/IB2012/001308

§ 371 (c)(1),
(2), (4) Date: Feb. 12, 2015

(87) PCT Pub. No.: WO2014/006434

PCT Pub. Date: Jan. 9, 2014

(65) Prior Publication Data

US 2015/0184352 A1 Jul. 2, 2015

(51) Int. Cl.
*E02D 5/14* (2006.01)
*E02D 5/06* (2006.01)

(52) U.S. Cl.
CPC ... *E02D 5/14* (2013.01); *E02D 5/06* (2013.01)

(58) Field of Classification Search
CPC ..... E02D 5/06; E02D 5/14
See application file for complete search history.

(56) References Cited

FOREIGN PATENT DOCUMENTS

| | | | |
|---|---|---|---|
| BE | 1006600 | A3 | 10/1994 |
| DE | 2722978 | A1 | 11/1978 |
| DE | 4345026 | A1 | 3/1995 |
| EP | 0695832 | A1 | 2/1996 |
| NL | 7804111 | A | 11/1978 |

*Primary Examiner* — Tara M. Pinnock
(74) *Attorney, Agent, or Firm* — Reinhart Boerner Van Deuren P.C.

(57) ABSTRACT

A method and a tool (10) for forming a seal in a lock chamber (3) of a sheet pile are proposed. The method comprises the steps of: introducing a seal forming tool (10) into the lock chamber (3); injecting a sealing material into a distribution chamber (50) of the tool (10) from where it axially fills longitudinally extending recesses (38', 38'', 38''') in a seal-shaping module (12); and moving the tool (10) longitudinally through the lock chamber (3), whereby the sealing material is shaped by the seal-shaping module (12). The distribution chamber (50) is a closed chamber inside the tool (10) and spaced from the longitudinally extending recesses (38', 38'', 38'''); and the tool (10) comprises moreover at least two distribution channels (52', 52'', 52''') connecting in parallel the distribution chamber (50) to the recesses (38', 38'', 38'''), the parallel distribution channels (52', 52'', 52''') being fine-tuned for apportioning the flow of sealing material between the recesses (38', 38'', 38''').

15 Claims, 1 Drawing Sheet

METHOD AND TOOL FOR FORMING A SEAL IN A BLOCK CHAMBER OF A SHEET PILE

TECHNICAL FIELD

The present invention generally relates to a method and a tool for forming a seal in a lock chamber of a sheet pile.

BACKGROUND ART

Sheet pile locks are well known in the art. They allow forming a connection between sheet piling elements by sliding or by threading a longitudinally extending lock strip of a first sheet pile element into a longitudinally extending lock chamber of a second sheet pile element.

In such sheet pile connections, there is always a certain functional play or clearance between the interlocking lock parts. Therefore, if a sheet pile wall has to be relatively tight, it is known to equip the sheet pile locks with seals sealing the play or clearance between the interlocking lock parts.

Various methods and tools have already been proposed for forming a seal directly in a lock chamber of a sheet pile.

According to the method disclosed in DE 27 22 978, a sealing product of a paste-like consistency is applied under pressure onto the bottom wall of the lock chamber. The still malleable bead is then spread and shaped with a kind of "scraper blade". This "scraper blade" confers to the bead the desired shape on the lock chamber walls, before the sealing product hardens by polymerization.

According to the method disclosed in EP 0 695 832, the sealing material is introduced into the locking chamber by a tool comprising several recesses, which extend in the longitudinal direction of the locking chamber and correspond in their cross-section to the desired profiled shape of the seal. This tool comprises a through-going transverse bore which extends directly into these recesses. Through this transverse bore, the sealing material is pressed into the recesses, wherein the sealing material is profiled and receives its final shape in the recesses of the tool.

According to the method disclosed in DE 43 45 026, the seal is formed by a tool comprising a central feeding chamber provided with a dorsal entrance bore communicating with a reservoir or other means for supplying the sealing compound. This central feeding chamber is a space directly delimited in the lock chamber (i.e. by the walls of the lock chamber), wherein it axially extends between a front-end guide block of the tool, which has a cross-section which is substantially identical to the lock chamber for guiding the tool in the latter, and a rear-end seal shaping mandrel of the tool, for shaping the sealing material at the outlet of the central feeding chamber. The seal shaping mandrel has a cross-section determining in cooperation with the walls of the lock chamber the final profile of the seal. For this purpose the mandrel includes several longitudinally extending recesses, which axially open into the central feeding chamber. When carrying out the proposed method, the sealing material is injected into the central feeding chamber, so as to always completely fill the lock chamber between the front-end guide block and the rear-end mandrel. The tool is longitudinally moved through the lock chamber. From the central feeding chamber, the sealing material flows axially along the mandrel and through the recesses in the latter, which confer the final profile to the seal.

These prior art methods basically allow producing sheet pile seals with a relatively simple profile. However, when trying to produce sheet pile seals with more complicated profiles, such as e.g. sheet pile seals including longitudinally extending seal lips of different cross-sections, which have to be precisely dimensioned and arranged within the lock chamber, then the result achieved with these prior art methods is not very satisfactory. Indeed, with the prior art methods, such seal lips are often either incompletely formed, or are deformed because the sealing material bulges at the outlet of the seal shaping tool.

An object underlying the proposed invention is consequently, to provide a method for forming a seal in a lock chamber of a sheet pile, which allows to achieve more precise and complicated sheet pile seal profiles, than the aforementioned prior art methods. A further object is to provide a tool for such a method that is particularly robust and easy to use.

SUMMARY OF INVENTION

The invention proposes a method for forming a seal in a lock chamber of a sheet pile, comprising the steps of:

- introducing a seal forming tool into the lock chamber, the tool comprising a seal-shaping module with longitudinally extending recesses facing at least one lock chamber wall for shaping the seal, and a sealing material distribution chamber, which is in communication with the recesses;
- injecting a sealing material into the distribution chamber, from where it axially fills the longitudinally extending recesses; and
- moving the tool longitudinally through the lock chamber, whereby the sealing material is shaped by the seal-shaping module to receive the final form of the seal.

In accordance with one aspect of the invention, the distribution chamber is a closed chamber arranged inside the tool (i.e. the distribution chamber is not in direct communication with the lock chamber) and spaced from the longitudinally extending recesses (i.e. the longitudinally extending recesses do not directly open into the distribution chamber); and the tool comprises at least two distribution channels connecting in parallel the distribution chamber to the recesses; these parallel distribution channels being fine-tuned for apportioning the flow of sealing material between the recesses.

It will be appreciated that by fine-tuning the pressure drop in these distribution channels (e.g. by providing distribution channels with different cross-sections and/or distribution channels with throttle means incorporated therein), the flow of sealing material can be finely apportioned between the seal shaping recesses. Thus, it gets possible to avoid that either not enough or too much sealing material is fed into a seal shaping recess. A locally insufficient flow rate of sealing material would result in that a recess is not completely filled with sealing material at its outlet, so that an incompletely formed seal lip would be produced. A locally excessive flow rate of sealing material would however result in that sealing material bulges at the outlet of a recess, so that a deformed seal lip would be produced. By using parallel distribution channels, which are fine-tuned for apportioning the flow of sealing material between the recesses, the proposed method avoids the aforementioned draw-backs, and allows achieving a more precise seal profile than the aforementioned prior art methods. This is in particular the case, if the seal shaping recesses (or, in other words, the seal lips to be formed) have unequal cross-sections and/or show an asymmetrical arrangement in the lock chamber.

It will further be appreciated that the tool used for carrying out the proposed method is—in comparison to a tool as disclosed e.g. in EP 0 695 832—particularly robust. Indeed, the seal-shaping module of the tool—which is already weakened by the longitudinally extending recesses—is not further weakened by any kind of feeding channel.

Preferably, the distribution chamber is arranged axially in front of the seal forming tool; i.e. the distribution chamber precedes the seal forming tool when the tool is longitudinally moved through the lock chamber. In this embodiment, distribution channels, having a reduced cross-section in comparison to the recesses, may then axially extend the recesses into the distribution chamber. It will be appreciated that this configuration results in a very simple and robust, but nevertheless very efficient tool for carrying out the proposed method.

In a preferred embodiment, each of the distribution channels forms an outlet opening in an end face of one of the recesses, wherein this outlet opening has a smaller cross-section than the recess. It is assumed that this preferred embodiment contributes to a high quality seal, amongst others because: (i) the strand of sealing material axially penetrating into the recess through a smaller outlet opening may still expand in the recess before receiving its final shape; and (ii) the relative velocity between the strand leaving the distribution channel and the seal-shaping module is higher.

The seal-shaping module advantageously comprises a first front face into which the recesses open, and a second front face into which the distribution chamber opens. The tool then further comprises a supply module with a front surface into which a sealing material supply channel opens. The seal-shaping module is removably fixed with its second front face to the front face of the supply module, so that the distribution chamber is sealed at its periphery and the sealing material supply channel opens into the distribution chamber. In this tool, the distribution channels and the distribution chamber may be easily cleaned by simply dismounting the seal-shaping module from the supply module. If worn out or damaged, the seal-shaping module may moreover be easily replaced.

For forming separate seal-lips, at least two recesses are separated by a longitudinally extending abutment surface directly facing the lock chamber wall.

The fine-tuned distribution channels may simply be bore holes with different diameters extending longitudinally through the seal-shaping module. Such distribution channels can be very easily produced and be fine-tuned with regard to the pressure drop therein.

The seal-shaping module normally has a cross-section that, when ignoring the recesses, is essentially complementary to the cross-section of the lock chamber. However, if the seal is to be formed only on some wall parts of the lock chamber, the seal-shaping module may also have a cross-section that is much smaller than the cross-section of the lock chamber, i.e. its cross-section may not necessarily be complementary to the cross-section of the lock chamber.

A preferred embodiment of the tool used in the method includes a rounded (more particularly a convex-cylindrical) guiding surface arranged in front of the seal-shaping module, wherein this guiding surface is pressed into a rounded (more particularly a concave-cylindrical) lock chamber corner (which is formed by two adjoining walls of the lock chamber), when the tool is longitudinally moved through said lock chamber. It will be appreciated that this solution of guiding the tool in a rounded lock chamber corner, is relatively insensitive to rolling defects in the lock chamber and allows dealing with relatively important tolerances on the dimensions or the geometry of the lock chamber.

The sealing material is normally a paste-like mass when it is injected, which hardens in the lock chamber.

In a preferred embodiment of the method, which is particularly suited for equipping the lock chamber of a LARSSEN type sheet pile lock with a lip seal, the seal-shaping module comprises: three longitudinally extending recesses having substantially triangular cross-sections of different sizes; and for each of the recesses, a bore hole arranged in axial extension of the respective recess and connecting the latter to the distribution chamber; wherein the parallel bore holes have different diameters and/or include throttle means for apportioning the flow of sealing material between the recesses, in function of the size of the cross-section of each recess.

The invention proposes a tool for carrying out the method as defined hereinbefore.

BRIEF DESCRIPTION OF DRAWINGS

The afore-described and other features, aspects and advantages of the invention will be better understood with regard to the following description of an embodiment of the invention and upon reference to the attached drawings, wherein.

DETAILED DESCRIPTION OF EMBODIMENT OF THE INVENTION

Figure 3:
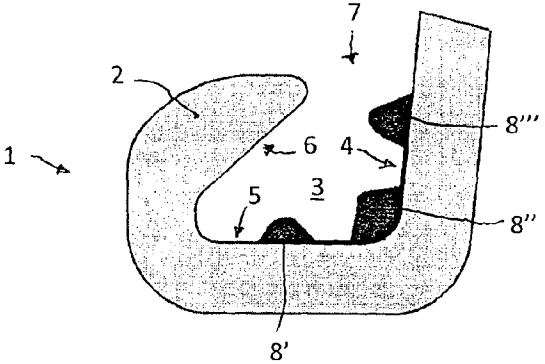
FIG. 3 is a cross-section of a LARSSEN type lock of a sheet pile, having in its lock chamber a seal formed in accordance with the invention; it will be noted that FIG. 3 is not drawn at the same scale as FIG. 1 and FIG. 2.

FIG. 3 shows—as an example of a typical sheet pile lock—a so-called LARSSEN type lock 1. Such a sheet pile lock 1 extends typically along a longitudinal edge of a sheet pile (as e.g. a Z-shaped, U-shaped or flat sheet pile), or is fixed to a so-called intermediate carrier element (as e.g. a double-T pile or a tubular pile), or is part of a separate sheet pile connection section. This sheet pile lock 1 is used for coupling thereto another sheet piling element equipped with a complementary sheet pile lock. It includes a hook strip 2 and a lock chamber 3. The lock chamber 3 is delimited by a rear wall 4, a bottom wall 5 and an inclined internal surface 6 of the hook strip 2. The hook strip 2 defines with the rear wall 4 a so-called lock jaw 7, which gives access to the lock chamber 3. In the lock chamber 3 is incorporated a seal 8 consisting in this example basically of three seal-lips 8', 8" and 8'", which extend longitudinally through the lock chamber 3. The first seal lip 8' is arranged on the bottom wall 5, the second seal lip 8" in the concavely rounded corner between the rear wall 4 and the bottom wall 5, and the third seal lip 8'" on the rear wall 4 of the lock chamber 3. It will be noted that the three seal-lips 8', 8" and 8'" have unequal cross-sections, that they are laterally spaced from each other and that the height of seal-lips 8" and 8'" is relatively important. With a prior art method, reliably producing such a seal profile would, if at all, not be easily feasible.

Figure 2:
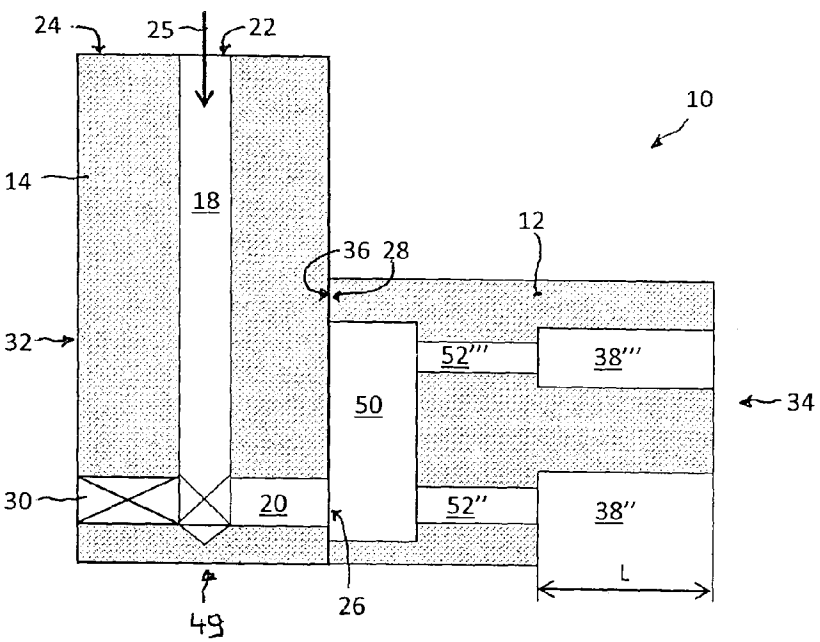
FIG. 2 is a simplified two-plane cross-section of the tool of FIG. 1, wherein, the section plane for part 14 is identified in FIG. 1 with dash-dot line X-X', and that for part 12 is identified with dash-dot line Y-Y'.
Figure 1:
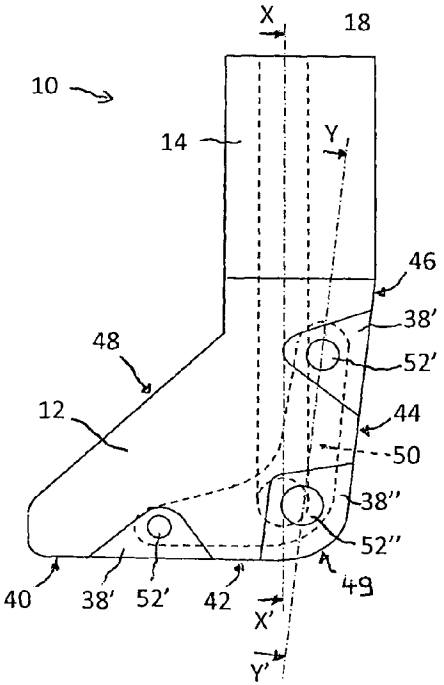
FIG. 1 is a simplified elevation view of a tool for forming a sheet pile seal in accordance with the invention.

FIG. 1 and FIG. 2 show a preferred tool 10 for carrying out, in accordance with the present invention, a method for forming such a seal 8 in a lock chamber 3 of a sheet pile lock. This tool 10 essentially comprises a seal-shaping module 12 and sealing material supply module 14 (see FIG. 2). As seen in the section of FIG. 1, the lower part of the tool 10 has a cross-section that is basically complementary to the cross-section of the lock chamber, in the present case e.g. to the lock chamber 3 of the LARSSEN type lock 1 as shown in FIG. 3. This lower part of the tool 10 is dimensioned so that it can be introduced into the lock chamber 3 of the sheet pile lock 1 and be longitudinally moved along the latter. The upper part of the tool 10 protrudes hereby through the lock jaw 7 out of the lock chamber 3.

As seen in FIG. 2, the supply module 14 essentially comprises a sealing material supply channel formed by a bore 18, which is transverse to the longitudinal axis of the lock chamber 3 when the tool 10 is received in the lock chamber 3, and a bore 20, which is parallel to this longitudinal axis. The bore 18 forms an inlet opening 22 in a top surface 24 of the supply module 14. This inlet opening 22 can be connected to a line (not shown) or a container (not shown) for pressing a sealing material under the form of a paste-like mass into the tool 10 (see arrow 25). A preferred sealing material is e.g. a MS-polymer. The bore 20 forms first outlet opening 26 in a first front face 28 of the supply module 14, to which the seal-shaping module 12 is releasably connected. Reference number 30 identifies a plug closing a second outlet opening of the bore 20 in an opposite second front face 32 of the supply module 14.

The seal-shaping module 12 is basically a body having, between a first front face 34 and a second front face 36, a cross-section that is essentially complementary to the cross-section of the lock chamber 3. Into the first front face 34 open three longitudinally extending recesses 38', 38", 38'" having substantially triangular cross-sections with a rounded apex corner (see FIG. 1). These recesses have along the longitudinal direction of the lock chamber 3 a length L of only a few centimeters. When the tool 10 is received in the lock chamber 3, the recesses 38', 38", 38'" face a lock chamber wall over their length L. More particularly: in the lock chamber 3, the recess 38' faces the bottom wall 5, the recess 38'" faces a rear wall 4 and the recess 38" faces the concave corner defined by the rear wall 4 and the bottom wall 5 of the lock chamber 3.

In FIG. 1, reference numbers 40, 42, identify two abutment surfaces of the seal-shaping module 12, which are facing the bottom wall 5; and reference numbers 44, 46 two abutment surfaces of the seal-shaping module 12, which are facing the rear wall 4 of the lock chamber 3. In the present case, the seal-shaping module 12 comprises a front side 48 that is devoid of a recess. In the LARSSEN type lock chamber 3 of FIG. 3, this front side 48 faces the inclined internal surface 6 of the hook strip 2. The tool further includes a rounded (more particularly a convex-cylindrical) guiding surface 49 arranged in front of the seal-shaping module 12, e.g. on the material supply module 14. When the tool is longitudinally moved through the lock chamber 3, this guiding surface 49 is pressed into a rounded (more particularly a concave-cylindrical) lock chamber corner, which is formed by the two adjoining walls 4 and 5 of the lock chamber 3 and faces the lock jaw 7. It will be appreciated that this solution of essentially guiding the tool 10 in this rounded corner of the lock chamber 3, is relatively insensitive to rolling defects in the lock chamber 3 and allows dealing with relatively important tolerances on the dimensions and/or the geometry of the lock chamber. When the seal-shaping module 12 is pressed with its rounded guiding surface 49 into the rounded corner of the lock chamber 3, a clearance of some millimeters remains between the longitudinal front side 48 of the seal-shaping module 12 and the internal surface 6 of the hook strip 2. It will be appreciated that the bottom part of the tool 10 might even have a cross-section that is much smaller than the cross-section of the lock chamber 3 and possibly no longer complementary to the latter.

Into the second front face 36 of the seal-shaping module 12 opens a distribution chamber 50. The seal-shaping module 12 is fixed with this second front face 36 by means of screws (not shown) to the front face 28 of the supply module 14, so that distribution chamber 50 is sealed at its periphery by a sealing surface on the supply module 14, and the outlet opening 26 of the bore 20 opens into the distribution chamber 50. Alternatively, a symmetric embodiment of the seal-shaping module 12 could be fixed to the opposite front face 32 of the supply module 14, wherein the plug 30 would then close the outlet opening 26 of the bore 20. Thus, the tool 10 could be moved in the opposite direction through the lock chamber 3.

For each of the three recesses 38', 38", 38'", the seal-shaping module 12 includes a separate sealing material distribution channel, implemented here under the form of a bore hole 52', 52", 52'", which is arranged in axial extension of the respective recess 38', 38", 38'" and connects the latter to the distribution chamber 50. As best seen in FIG. 1, each of these bore holes 52', 52", 52'" forms an outlet opening in an end face of one of the recesses 38', 38", 38'", wherein this outlet opening has a smaller cross-section than the corresponding recess.

It will be noted that by conferring different diameters (i.e. different cross-sections) to the distribution channels 52', 52", 52'", it is possible to fine-tune the pressure drop in each distribution channel 52', 52", 52'", for apportioning the flow of sealing material between the three recesses 38', 38", 38'". In FIG. 1, the distribution channel 52' has e.g. the smallest diameter (i.e. causes the highest pressure drop), because the corresponding recess 38' has the smallest cross-section (i.e. the smallest linear volume) and requires therefore the smallest flow of sealing material. The distribution channel 52" has e.g. the biggest diameter (i.e. causes the smallest pressure drop), because the recess 38" has the biggest cross-section (i.e. the biggest linear volume), and the flow of sealing material to this recess 38" must therefore be bigger than the flow of sealing material to the other two recesses 38', 38'".

Instead of having a constant cross-section over its whole length, the distribution channel 52', 52" and/or 52'" may also be a stepped bore comprising e.g. an outlet opening with a bigger cross-section than its inlet section or vice versa. Furthermore, anyone of the distribution channels 52', 52" and/or 52'" may have a cross-section bigger than required for limiting the flow of sealing material to the desired value. The additional pressure drop for conveniently apportioning the flow of sealing material between the recesses 38', 38", 38'" may in this case be achieved by means of a throttle that is inserted (e.g. screwed) into the distribution channel 52', 52", 52'". Finally, the outlet opening of the distribution channel 52', 52" and/or 52'" must not necessarily be circular. It may e.g. be oval or have a form that comes closer to the section of the recess. Thus, in the tool 10 of FIG. 1, each of the outlet openings of the distribution channels 52', 52", 52'" may have the form of e.g. a triangle.

As can be seen on FIG. 1, the distribution chamber 50 has in the cross-section substantially the form of an "L", with branches of substantially the same length, wherein the openings of the bore holes 52', 52", 52'" in the distribution chamber 50 are located at each end of the branches of the L and at the intersection of the two branches of the "L". The outlet opening 26 of the bore 20 opens into the distribution chamber 50 also at the intersection of the two branches of the "L", substantially opposite of the opening of the distribution channel 52".

For forming the seal 8 in the lock chamber 3, the lock chamber is preferably cleaned and provided with a primer. Then, the lower part of the tool 10 with the seal-shaping module 12 is introduced into the lock chamber 3, wherein the upper part of the tool 10 protrudes through the lock jaw 7 out of the lock chamber 3. The paste-like sealing material is pressed, e.g. by means of pump, through the sealing material supply channel 18, 20 into the internal distribution chamber 50. From the distribution chamber 50, the sealing material flows through the distribution channels 52', 52", 52'" axially into the recesses 38', 38", 38'".

The seal is formed by moving the tool 10, with the supply module 14 first, longitudinally through the lock chamber 3, wherein the seal-shaping module 12 is pressed with its abutment surfaces 40, 42 against the bottom wall 5, and its abutment surfaces 44, 46 against the rear wall 4 of the lock chamber 3. The paste-like sealing material axially flows through the recesses 38', 38", 38'". These recesses 38', 38", 38'" shape the seal lips 8', 8", 8'" on the bottom wall 5 and the rear wall 4 of the lock chamber 3, so that the seal 8 has its final form at the outlet of the recesses 38', 38", 38'", i.e. behind the moving seal-shaping module 12. The velocity with which the seal-shaping module 12 is moved through the lock chamber 3 and the pressure with which the sealing material is pressed into the supply channel 18, 20, are process parameters that must be optimized in a test phase, so that the sealing material completely fills the outlet section of each of the recesses 38', 38", 38'", without however bulging at this outlet section. By adjusting, as explained already hereinbefore, the pressure drop in each distribution channel 52', 52", 52'", it becomes possible to finely apportion the flow of sealing material between the recesses 38', 38", 38'" in function of the linear volume of each recess. This warrants that the seal lips 8', 8", 8'" are properly formed in the lock chamber 3.

It will be further be appreciated that the proposed tool is very robust and therefor particularly suited for being used in lock chambers of sheet piles, in which the walls 4, 5, 6 are most often relatively rough. Furthermore, due to the fact that the seal-shaping module 12 may be easily dismounted, it is easily possible to clean the distribution chamber 50, the distribution channels 52', 52", 52'" and the recesses 38', 38", 38'" and, if its abutment surfaces 40, 42, 44, 46 are worn out, to simply replace the seal-shaping module 12.

Even if the invention has been described hereinbefore with reference to LARSSEN type lock chambers, the person skilled in the art may easily adapt the tool for other geometries of lock chambers. Furthermore, a method/tool in accordance with the present invention may of course be used to manufacture a seal with less than three lips or with more than three lips, and some or all of these lips may have a common base (i.e. two consecutive recesses in the tool are this case not separated by an abutment surface, which contacts or is at least located very close to the lock chamber wall, but by a surface that is spaced from the lock chamber wall when the seal-shaping module is longitudinally moved through the lock chamber).

Reference signs list

| | |
|---|---|
| 1 | LARSSEN type lock |
| 2 | hook strip |
| 3 | lock chamber |
| 4 | rear wall |
| 5 | bottom wall |
| 6 | internal surface of 2 |
| 7 | lock jaw |
| 8 | seal formed by 8', 8", 8'" |
| 8' | first seal lip |
| 8" | second seal lip |
| 8'" | third seal lip |
| 10 | tool |
| 12 | seal-shaping module |
| 14 | material supply module |
| 18 | bore of supply channel |
| 20 | bore of supply channel |
| 22 | inlet opening of 18 |
| 24 | top surface of 14 |

-continued

Reference signs list

| | |
|---|---|
| 25 | arrow |
| 26 | first outlet opening of 20 |
| 28 | first front face of 14 |
| 30 | plug in 20 |
| 32 | second front face of 14 |
| 34 | first front face of 12 |
| 36 | second front face of 12 |
| 38' | recess in 12 facing 5 |
| 38" | recess in 12 facing corner 4, 5 |
| 38'" | recess in 12 facing 4 |
| 40 | abutment surface on 12 |
| 42 | abutment surface on 12 |
| 44 | abutment surface on 12 |
| 46 | abutment surface on 12 |
| 48 | longitudinal front side of 12 |
| 49 | guiding surface |
| 50 | distribution chamber |
| 52' | distribution channel/bore hole |
| 52" | distribution channel/bore hole |
| 52'" | distribution channel/bore hole |

The invention claimed is:

1. A method for forming a seal in a lock chamber of a sheet pile, comprising the steps of:

introducing a seal forming tool into said lock chamber, said tool comprising a seal-shaping module with longitudinally extending recesses facing at least one lock chamber wall for shaping said seal, and a distribution chamber, which is in communication with said recesses;

injecting a sealing material into said distribution chamber from where it axially fills said recesses; and moving said tool longitudinally through said lock chamber, whereby said sealing material is shaped by said seal-shaping module to receive the final form of said seal;

wherein:

said distribution chamber is a closed chamber inside said tool that is spaced from said longitudinally extending recesses; and said tool comprises at least two distribution channels connecting in parallel said distribution chamber to said recesses.

2. The method as claimed in claim 1, wherein:

each of said distribution channels forms an outlet opening in an end face of one of said recesses, said outlet opening having a smaller cross-section than said recess.

3. The method as claimed in claim 1, wherein:

said seal-shaping module comprises a first front face into which said recesses open, and a second front face into which said distribution chamber opens;

said tool further comprises a sealing material supply module with a front surface into which a sealing material supply channel (18, 20) opens; and said seal-shaping module is removably fixed with its second front face to said front face of said supply module, so that said distribution chamber is sealed at its periphery and said sealing material supply channel opens into said distribution chamber.

4. The method as claimed in claim 1, wherein:

at least two recesses are separated by a longitudinal abutment surface directly facing said lock chamber wall.

5. The method as claimed in claim 1, wherein:

said distribution channels are longitudinally extending bore holes with different diameters.

6. The method as claimed in claim 1, wherein:

said tool includes a rounded guiding surface arranged in front of said seal-shaping module, said guiding surface being pressed into a rounded lock chamber corner, when said tool is longitudinally moved through said lock chamber.

7. The method as claimed in claim 1, wherein:

said sealing material is a paste-like mass when it is injected into said lock chamber and said sealing material hardens in said lock chamber.

8. The method as claimed in claim 1, wherein said seal-shaping module comprises:

three longitudinally extending recesses having substantially triangular cross-sections of different sizes; and for each of said recesses, a bore hole arranged in axial extension of the respective recess and connecting the latter to the distribution chamber;

wherein said parallel bore holes have different diameters and/or include throttle means for apportioning the flow of sealing material between said recesses.

9. A tool for forming a seal in a lock chamber of a sheet pile, comprising:

a seal-shaping module with longitudinally extending recesses designed for facing a lock chamber wall for shaping said seal; and a sealing material distribution chamber, which is in communication with said longitudinally extending recesses;

wherein:

said distribution chamber is a closed chamber inside said tool and spaced from said longitudinally extending recesses; and said tool comprises at least two distribution channels connecting in parallel said distribution chamber to said recesses.

10. The tool as claimed in claim 9, wherein:

each of said distribution channels forms an outlet opening in an end face of one of said recesses, said outlet opening having a smaller cross-section than said recess.

11. The tool as claimed in claim 9, wherein:

said seal-shaping module comprises a first front face into which said recesses open, and a second front face into which said distribution chamber opens;

said tool further comprises a supply module with a front surface into which a sealing material supply channel opens; and said seal-shaping module is removably fixed with its second front face to said front face of said supply module, so that said distribution chamber is sealed at its periphery and said sealing material supply channel opens into said distribution chamber.

12. The tool as claimed in claim 9, wherein:

at least two recesses are separated by a longitudinal abutment surface directly facing said lock chamber wall.

13. The tool as claimed in claim 9, wherein:

said distribution channels are longitudinally extending bore holes with different diameters.

14. The tool as claimed in claim 9, wherein:

said tool includes a rounded guiding surface arranged in front of said seal-shaping module, so as to be capable of being pressed into a rounded lock chamber corner, when said tool is longitudinally moved through said lock chamber.

15. The tool as claimed in claim 9, wherein said seal-shaping module comprises:

three longitudinally extending recesses having substantially triangular cross-sections of different sizes; and for each of said recesses, a bore hole arranged in axial extension of the respective recess and connecting the latter to the distribution chamber;

wherein said parallel bore holes have different diameters and/or include throttle means for apportioning the flow of sealing material between said recesses.

* * * * *